United States Patent [19]

Spinning

[11] Patent Number: 4,628,610

[45] Date of Patent: Dec. 16, 1986

[54] ADJUSTABLE RADIAL CURVE RADIUS SETTING SCALE

[76] Inventor: Richard R. Spinning, 2280 Clifton St., Sebring, Fla. 33870

[21] Appl. No.: 832,953

[22] Filed: Feb. 26, 1986

Related U.S. Application Data

[63] Continuation-in-part of Ser. No. 736,727, May 22, 1985, Pat. No. 4,587,740, which is a continuation-in-part of Ser. No. 525,207, Aug. 22, 1983, Pat. No. 4,532,714, which is a continuation-in-part of Ser. No. 454,527, Dec. 30, 1982, abandoned.

[51] Int. Cl.[4] ..... B43L 13/20

[52] U.S. Cl. ..... 33/177

[58] Field of Search ..... 33/27 R, 27 F, 177, 33/178 R

[56] References Cited

U.S. PATENT DOCUMENTS

| | | | |
|---|---|---|---|
| 677,349 | 7/1901 | Gagarin | 33/177 |
| 989,547 | 4/1911 | Gran et al. | 33/177 |
| 1,061,345 | 5/1913 | Weston | 33/177 |
| 1,313,482 | 8/1919 | Hegardt | 33/177 |
| 1,380,240 | 5/1921 | Nies | 33/177 |
| 1,797,842 | 3/1931 | Schmieder | 33/177 |
| 1,887,391 | 11/1932 | Aras | 33/177 |
| 1,893,690 | 1/1933 | Weston | 33/177 |
| 1,900,500 | 3/1933 | Hinckelmann | 33/177 |
| 2,001,949 | 5/1935 | Weston | 33/177 |
| 2,798,299 | 7/1957 | Cooper | 33/177 |
| 3,134,176 | 5/1964 | Hoyle | 33/177 |
| 3,388,475 | 6/1968 | Yoshioka | 33/177 |
| 3,781,995 | 1/1974 | Debeaux | 33/177 |
| 4,532,714 | 8/1985 | Spinning | 33/177 |

FOREIGN PATENT DOCUMENTS

| | | | |
|---|---|---|---|
| 219330 | 2/1910 | Fed. Rep. of Germany | 33/177 |
| 964643 | 5/1957 | Fed. Rep. of Germany | 33/177 |

*Primary Examiner*—Richard R. Stearns

*Attorney, Agent, or Firm*—Sughrue, Mion, Zinn, Macpeak and Seas

[57] ABSTRACT

An adjustable radial curve radius setting scale is provided having an end supporting bar to which there is attached an assemblage of stacked elements. The stacked elements comprise a first level radial arm having connecting dowels, second and third level long chords are attached to the radial arms. Second and third level diagonal braces are attached to the first level radial arms. Fourth level diagonal braces are attached to the first level radial arms and fifth and sixth level brace chords are attached to the fourth level diagonal braces. The seventh level radial arms have outer guide pins and inner raised bosses with apertures to received the dowels of the lower radial arms. The assemblage is snap-fitted together by means of an O-ring on the dowels of the first radial arms. The assemblage is free to rotate to form a curve of any desired radii. At least one working edge is secured between the first and seventh radial arms and may be locked in a given pre-set radius by a latching mechanism.

12 Claims, 30 Drawing Figures

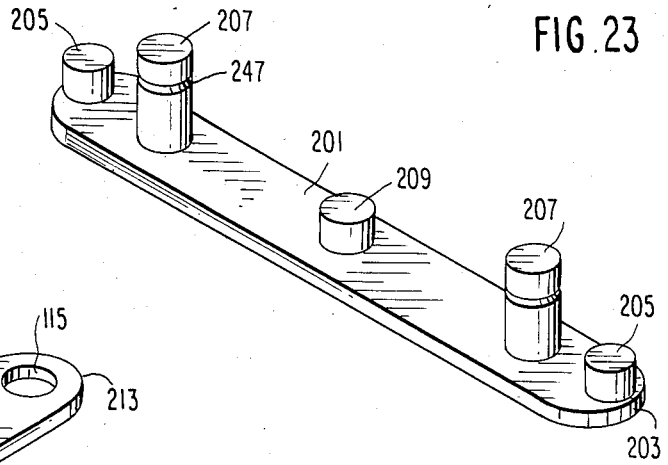
FIG. 23
FIG. 24
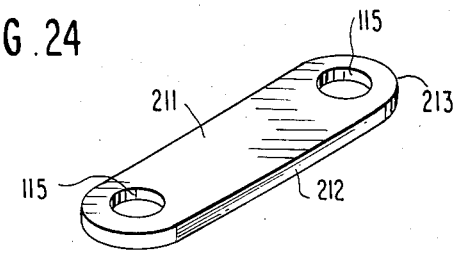
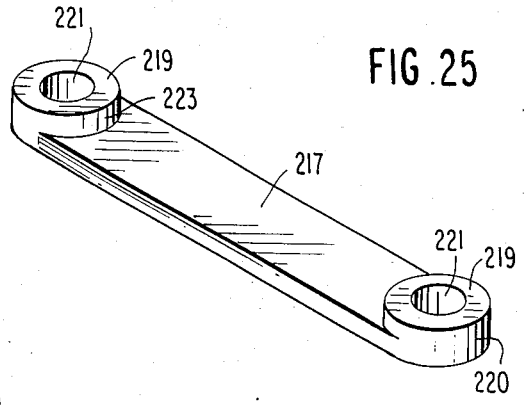
FIG. 25
FIG. 26
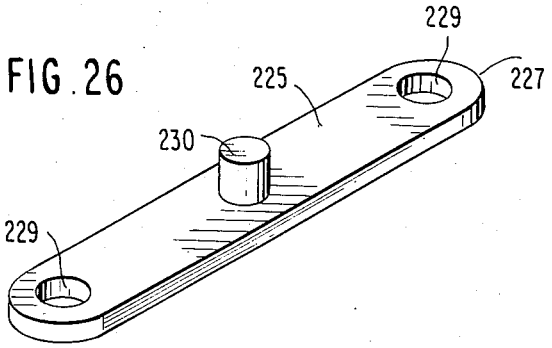
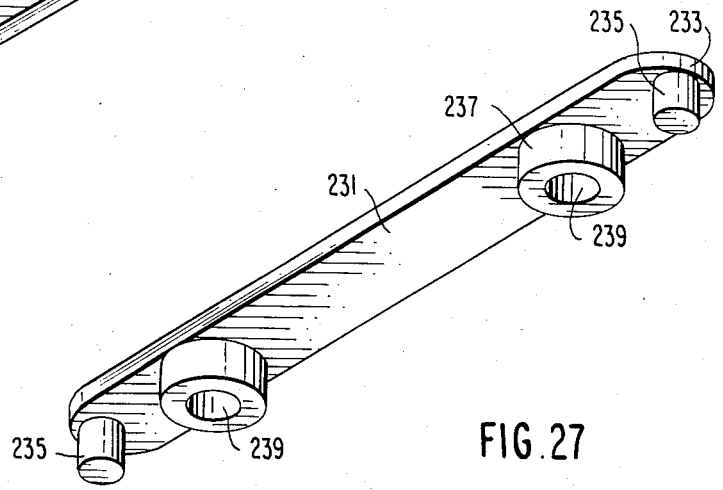
FIG. 27

ADJUSTABLE RADIAL CURVE RADIUS SETTING SCALE

CROSS REFERENCE

This is a C.I.P. of application Ser. No. 736,727, now U.S. Pat. No. 4,587,740, filed May 22, 1985, which in turn is a C.I.P. application of Ser. No. 525,207, now U.S. Pat. No. 4,532,714, filed Aug. 22, 1983, which is a C.I.P. application of 424,527, now abandoned filed Dec. 30, 1982, and the contents of said application are made a part of this application by reference.

BACKGROUND OF THE INVENTION

1. Field of the Invention

This invention pertains to an adjustable radial curve radius setting scale for use as an aid in engineering and construction layout and design. The instrument is particularly useful in making curves of any radius. Artists and craftsmen will find this instrument helpful in constructing designs involving circles. This instrument is also useful in the aircraft and ship building industries as well as forming work on construction projects. Instructors will find this instrument to be versatile and useful in instructing students. Handymen will find a variety of uses for this instrument for home and outdoor projects. Even children will enjoy its versatility in constructing circles of any radius.

The instrument may be constructed in various sizes to accommodate projects of all sizes. The instrument components are precisely dimensioned and assembled such that the ruling edge provides extreme accuracy.

The adjustable radial curve radius setting scale is 100 percent accurate throughout its entire length. It is constructed using the principals of chord deflections and radial lines.

2. Statement of the Prior Art

Adjustable curved rulers or scribers are well-known. One such device is described in U.S. Pat. No. 2,798,299. This patent discloses an adjustable curve having a plurality of cylindrical weights attached together by a series of linkages. A flexible metal band is attached to the cylindrical weights in such a fashion that permits it to bend in a curve upon manipulation of the various weights. Another curved ruler is disclosed in U.S. Pat. No. 1,893,690. This tool comprises a flexible body formed of strips or ribbons of steel to which there is attached a flexible ruling edge. On the other hand, the present invention is a lightweight instrument formed of superimposed chords and braces and radial arms connected together by suitable pins so as to permit them to rotate and deflect dependently of each other. A ruling edge is attached in a manner to allow it to bend or flex upon adjustment of the assemblage. A bar scale is pivotably attached at one point to the supporting tangent bar and to the other end of the diagonal braces and radial arms. The other end of the bar scale is slidable through a glideway attached to another point on the tool. A base is provided having at least one guideway whereby radii of particular dimensions may be constructed.

U.S. Pat. No. 4,532,714 discloses an adjustable radial curve comprising six layers of components and including a ruling edge and a bar scale.

| Patentee | Patent No. | Issue Date |
|---|---|---|
| Riegel | 20,121 | Oct. 29, 1863 |

-continued

| Patentee | Patent No. | Issue Date |
|---|---|---|
| Wollenhaupt | 219,330 | Feb. 21, 1910 |
| P. A. Gagarin | 677,349 | July 2, 1901 |
| A. Gran J. H. Karlson | 989,547 | Apr. 11, 1911 |
| W. S. Weston | 1,061,345 | May 13, 1913 |
| A. E. Hegardt | 1,313,482 | Aug. 19, 1919 |
| G. J. Nies | 1,380,240 | May 31, 1921 |
| K. Schmieder | 1,797,842 | Mar. 24, 1931 |
| W. S. Weston | 1,893,690 | Jan. 30, 1933 |
| F. D. Hinckelmann | 1,900,500 | Mar. 7, 1933 |
| F. D. Cooper | 2,798,299 | July 9, 1957 |
| J. E. Hoyle | 3,134,176 | May 26, 1964 |
| Toshio Yoshioka | 3,388,475 | June 18, 1968 |
| Debeaux | 3,781,995 | Jan. 1, 1974 |
| Richard R. Spinning | 4,532,714 | Feb. 22, 1985 |

SUMMARY OF THE INVENTION

This invention is designed to provide a novel adjustable radial curve instrument which can be manufactured at low cost and assembled in various sizes to meet the demands of draftsmen, engineers, construction personnel, craftsmen and laymen in performing or solving a variety of problems involving curves of any radius.

Another object of this invention is to provide an instrument formed of stacked components comprising radial arms, long chords, diagonal braces and brace chords all of which are attached by suitable pin assemblies such as to permit free movement of the components as they dependently rotate about each other.

Yet another object of this invention is to construct a instrument having a flexible ruling edge connected to the ends of the radial arms and diagonal braces such that a curve of any radius may be formed upon adjustment of the stacked components.

And still another object of this invention is to provide a instrument having a removable bar scale adjustably attached to the tool so as to permit the user to set or determine the radius of any given curve.

Still another object of this invention is to provide a instrument having stacked adjustable components, at least one flexible ruling edge attached to the stacked adjustable components, and a base support for the instrument.

And still another object of this invention is to provide a base with means to secure one end of the instrument to said support and having guideway means for the opposite end thereof.

Another object of the invention is to provide the base with at least one guideway and scale for routing the tool. A transparent cover is provided for the base whereby the instrument may be viewed while on store shelves.

And yet another object of this invention is to provide an adjustable radial curve radius resting scale comprising stacked interconnected elements bendible to form an arc, a ruling edge attached to the elements and a scale for determining a given arc.

And another object of the invention is to provide an adjustable radial curve using molded or die cast components having integral guide pins and dowels on the first and seventh layers and intermediate components having circular holes to permit all of the components to be connected together without the use of spacers and separate multiple pin assemblies.

Another object of the invention is to provide a seventh layer component having rounded ends, guide pins adjacent the rounded edges and dowel pins next to the guide pins and a center dowel. The first layer or component has rounded ends, guide pins adjacent the rounded ends and raised circular bosses having apertures therein adjacent the guide pins. It will be appreciated that the guide pins and dowels of the seventh layer cooperate with the guide pins and raised bosses with apertures of the first layer to receive the intermediate layers whereby all seven components are firmly connected together.

Other objects of this invention will become apparent from a reading of the specification when considered in light of the annexed drawings.

BRIEF DESCRIPTION OF THE DRAWINGS

FIG. 23 is a perspective view of a first layer component having integral guide pins and dowels thereon.

FIG. 24 is a perspective view of the second and third level long chords which is also identical to the fifth and sixth level brace chords.

FIG. 25 is a perspective view of the second and third level diagonal braces.

FIG. 26 is a perspective view of the fourth level diagonal brace.

FIG. 27 is a perspective view of the seventh level radial arm showing guide pins and adjacent raised rounded bosses with apertures.

Figure 1:
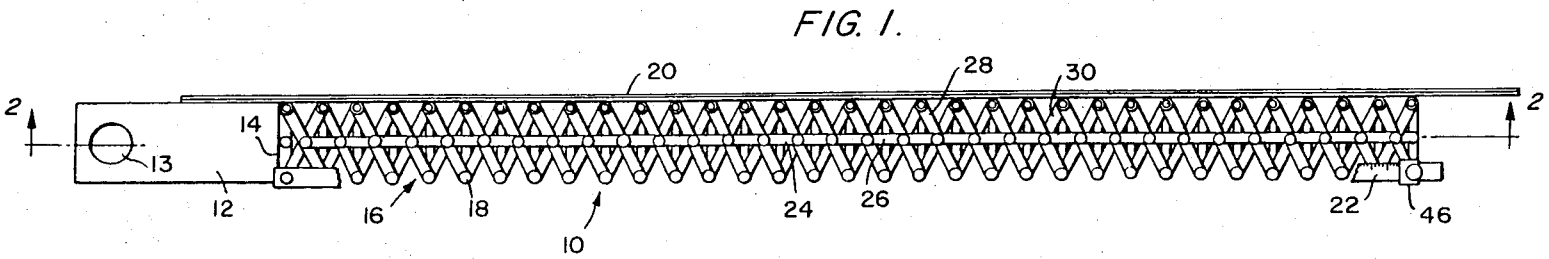
FIG. 1 is a plan view of the invention fully assembled.

DETAILED DESCRIPTION OF THE PREFERRED EMBODIMENT:

Referring in more detail to the drawings, in FIG. 1 there is shown an adjustable radial curve 10 comprising a supporting tangent bar 12 having an aperture 13 therein, a tangent end radial arm 14, a plurality of stacked elements 16 linked together by suitable pin assemblies 18 (one shown here), a ruling edge 20 and a bar scale 22.

Figure 2:
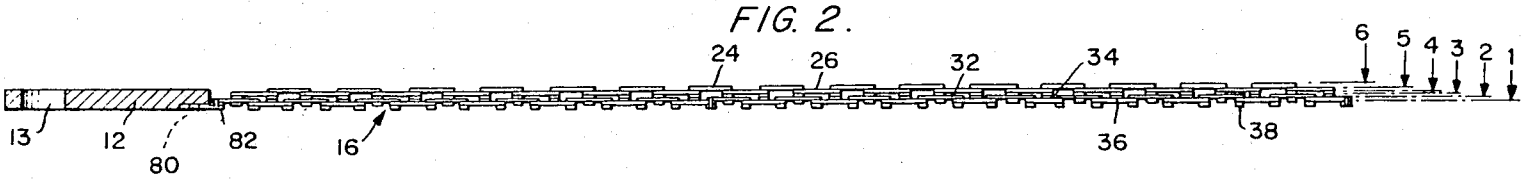
FIG. 2 is a longitudinal view of the invention taken along the line 2—2 of FIG. 1.

A side view of the instant invention as shown in FIG. 2 wherein the stacked elements 16 comprise sixth level brace chords 24, fifth level brace chords 26 underlapping the brace chords 24, fourth level diagonal braces 28, FIG. 1, third level diagonal braces 30, FIG. 1, third level long chords 32, FIG. 2, second level diagonal braces 34 below the third level diagonal braces 30, second level long chords 36 and first level radial rams 38. The six levels are shown at the right end of the structure as seen in FIG. 2. The stacked elements are connected together in various sets for rotation independently of each other. These connections will be described below.

Figure 3:
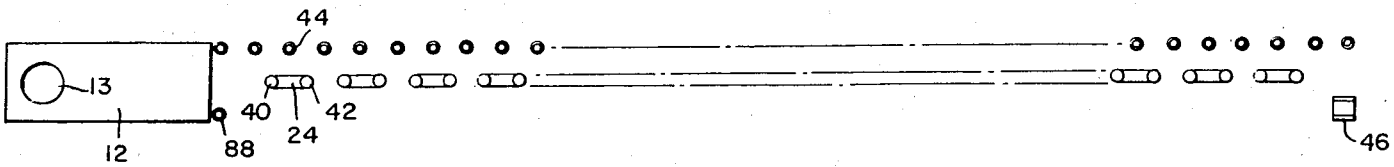
FIG. 3 is a plan view of the invention showing the sixth level assembly of upper brace chords, ruling edge attachment dowels and a guideway for the bar scale.
Figure 4:
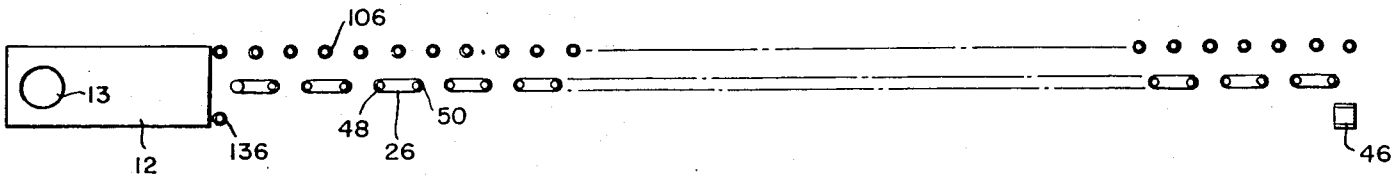
FIG. 4 is a plan view of the invention showing the fourth level assembly of lower brace chords.
Figure 5:
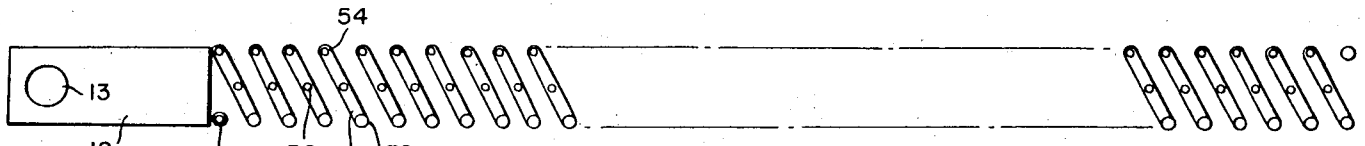
FIG. 5 is a plan view of the invention showing the fourth level assembly of diagonal brace components.
Figure 6:
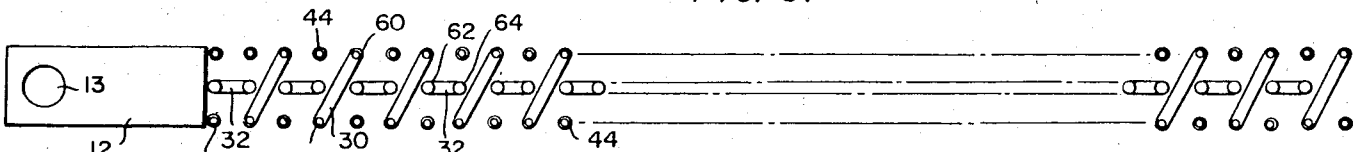
FIG. 6 is a plan view of the invention showing the third level assembly of long chords, diagonal braces and spacers for separating the components.
Figure 7:
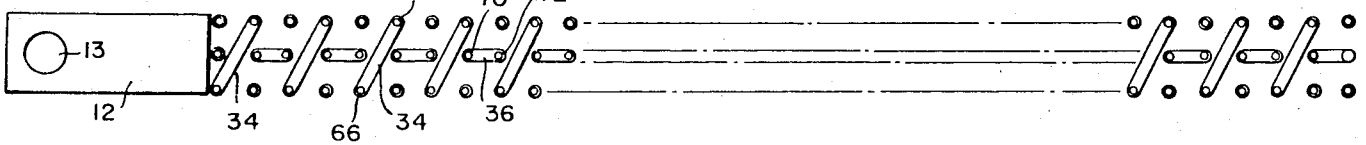
FIG. 7 is a plan view of the invention showing the second level assembly of long chords, diagonal braces and spacers.
Figure 8:
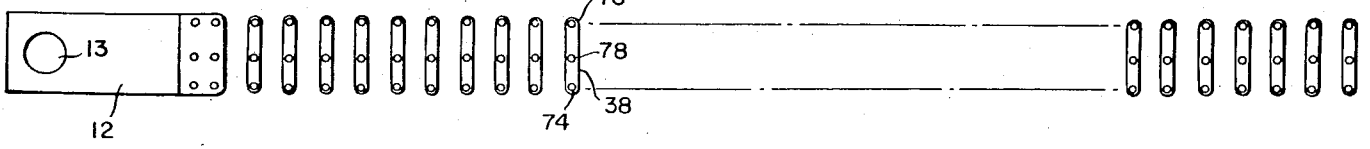
FIG. 8 is a plan view of the invention showing the lower level assembly of radial arms.
Figure 15:
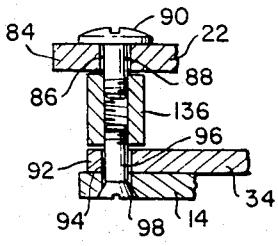
FIG. 15 is an elevated view of the instrument showing the connection of the fixed end of the bar scale to the diagonal brace and the tangent end radial arm.

FIG. 3 shows the sixth level brace chords 24 longitudinally aligned in spaced apart relationship. Apertures 40 and 42 extend through the brace chords for use with a pin assembly, to be described below. Ruling edge attachment dowels 106 are shown in FIG. 4 and are used in conjunction with front pin assembly, FIG. 13. A guideway 46 supports the free end of a bar scale 22, FIG. 4. The shank 88 of screw 90, FIG. 15, provides the pin about which the fixed end of the bar scale rotates. The next level of elements is shown in FIG. 4. This is the fifth level of brace chords 26 which have apertures 48 and 50 therein for receiving a pin assembly. The elements 24 and 26 overlap each other and are connected in such a fashion that they rotate and deflect relative to each other. The bar scale attachment dowel 136 receives the threaded end of shank 88, FIGS. 3 and 4. The fourth level of elements is shown in FIG. 5. The fourth level comprises diagonal braces 28 having apertures 52 and 54 therein near their ends thereof. A central aperture is shown at 56. The third level of elements is shown in FIG. 6. Third level comprises diagonal braces 30, which are oriented oppositely of the diagonal braces 28, having apertures 58 and 60 therein. Below the braces 30 and 34 is the third level of long chords 32 having apertures 62 and 64 therein. The second level of elements is shown in FIG. 7. The second level comprises diagonal braces 34 having apertures 66 and 68 therein. The braces 34 are parallel with but offset and below the braces 30. Between the braces 34 is the second level long chord elements 36 having apertures 70 and 72 therein for use with a pin assembly. The first level of elements is shown in FIG. 8. The first level of elements comprises the radial arms 38 having apertures 74 and 76 therein near the ends thereof and a central aperture 78 for use with a pin assembly.

In a typical instrument for engineering work, the long chords are in lengths of one half inches (½). The ends of all of the elements are rounded to a radius equal to one half (½) their width. The rounding is very important along the ruling edge connection side so as to diminish the point of contact between the ruling edge and the elements. The elements are assembled by pin assemblies so that they override and overlap each other, FIGS. 2 and 9. The pin assembly connections to the lower and upper elements are flush with the surfaces of these elements so as to eliminate friction or protruding edges.

The assembly of elements will now be described in reference to FIGS. 2 and FIGS. 9 through 15. The tangent end radial arm 14 is fastened to an end of the tangent bar 12 by suitable screws 80. An edge 82 of the radial bar 14 extends beyond the edge of the tangent bar 12. The end 84 of the bar scale 22 has an aperture 86 to receive the threaded end of shank 88 of a screw 90, FIG. 13. The threaded end of the shank 88 threads into a threaded bore of an attachment dowel 136. One end 92 of diagonal brace 34, FIG. 15, has an aperture 94 for receiving the threaded shank 96 of a screw 98 having a beveled head that seats in a countersunk bore in the end radial arm 14. The threaded end of the shank threads into the opposite threaded end of the attachment dowel 136. The bar scale 22 and the end of the diagonal brace 34 are fastened so that they rotate freely and independently from each other. Free rotation is assured by extending the shank portion of screws 90 and 98 slightly below bar scale 22 and above diagonal brace 34 respectively.

Figure 13:
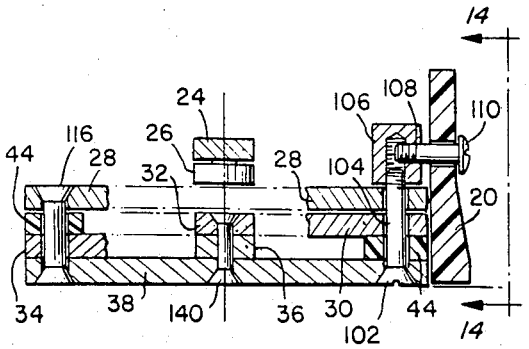
FIG. 13 is a sectional view along the line 13—13 of FIG. 9 and shows details of the spacers and the connections of the radial arms, diagonal braces, long chords and ruling edge.
Figure 14:
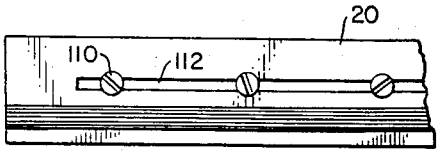
FIG. 14 is an elevational view of the ruling edge and is taken along the line 14–14 of FIG. 13.

The opposite ends of the second level diagonal braces 34 are connected to ends of the fourth level diagonal braces 28, and to spacers 44, as well as to the ends of radial arms 38 by a pin assembly 116 as shown in FIG. 13. The pin assembly in FIG. 13 shows a screw 102 having a smooth shank 104 with threaded end passing through apertures in the ends of the stacked elements and a spacer. Threaded dowels 106 are threaded onto the end of the screws so as to fasten the elements together for rotation independently of each other. The dowels 106 have lateral threaded bores for receiving the threaded ends 108 of screws 110 having a flat head and smooth shank of a length which will allow the rear face of the ruling edge 20 to just clear the stacked elements when tightly screwed into dowel 106. Manipulation of the curve will force the ruling edge to abut the rounded ends of the stacked elements. The smooth shank of the screw 110 passes through a slot 112 in the ruling edge 20, FIG. 14.

The front end of the fourth level diagonal brace 28 is fastened to the tangent end radial arm 14 by a pin and dowel assembly identical to that shown in FIG. 13. The opposite ends of the braces 38 are fastened to one end of a second or third level diagonal brace 34 and 30, and to an end of radial arm 38, as well as spacers 44 by a pin assembly 116, FIG. 13. This figure shows a countersunk aperture in the ends of the diagonal braces 28 and in the end of the radial arms 89. The countersunk apertures receive the beveled heads of suitable screws for seating in the countersunk bores. The pin assembly 116 of FIG. 13 is typical for connecting the diagonal braces and radial arms together for independent rotation of each other.

The second level long chords 36 and the third level long chords 32 overlap each other at the centers of the radial arms 38 and are fastened together by pin assembly 140, FIG. 13. The fifth level brace chord 26 and the sixth level brace chord 24 overlap each other at the centers of the fourth level diagonal braces 28 and are fastened together by pin assembly 142, FIG. 9.

Figure 11:
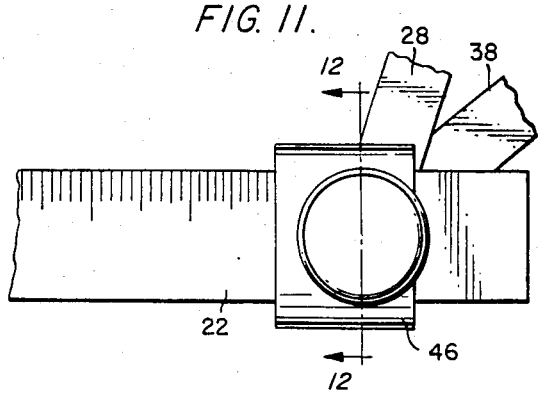
FIG. 11 is a plan view of the opposite end of the bar scale slidable through a guideway which is pivotably attached to a diagonal brace and a radial arm.
Figure 12:
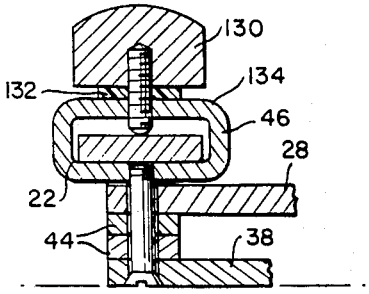
FIG. 12 is a side elevational view of the details of the bar scale guideway and connections to the diagonal brace and radial arm taken along the line 12—12 of FIG. 11.

FIGS. 11 and 12 are views showing the bar scale 22, guideway 46, fourth level diagonal brace 28 and the radial arm 38. A knurled screw 130 having a threaded shank 132 is turned into the top surface 134 of the guideway and bears against the top surface of the bar scale so as to secure the bar scale to the guideway. It is contemplated that the bar scale may be telescoped in nature whereby each end would be rigidly attached to the ends of the tool.

Alternatively, the bar scale may be removable by providing a locking device which would function to lock the ruling edge to a radial arm assembly.

Figure 16:
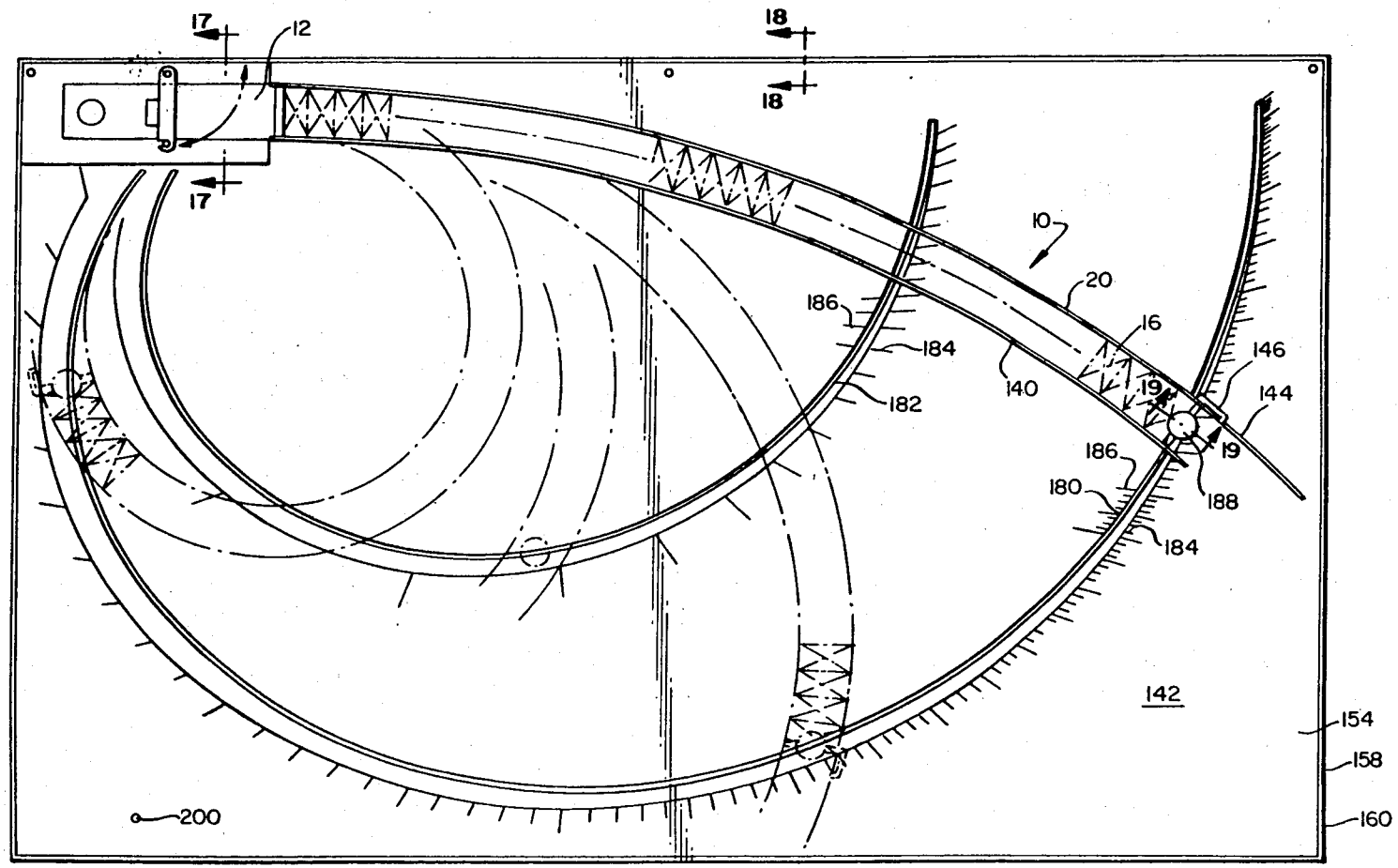
FIG. 16 is a plan view of the invention showing the adjustable radial curve secured to a base at one end, the opposite end movable about a guideway on the base.

In FIG. 16 there is shown an adjustable radial curve radius setting scale having a support tangent bar 12, a plurality of stacked element 16 and convex ruling edge 20, all of which were previously described in detail. This structure shows a second concave ruling edge 140 which will be described below and a base 142 for the instrument. The bar scale 22 is thus eliminated.

Figure 20:
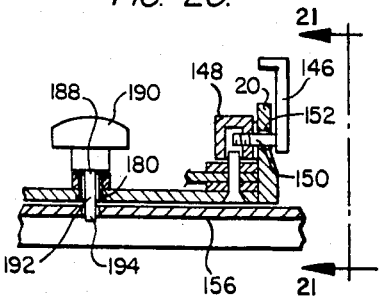
FIG. 20 is a view through line 20—20 of FIG. 19 and shows the base and guideway pin extending therethrough and a ruling edge with means to fasten same to the end radial arm assembly.
Figure 21:
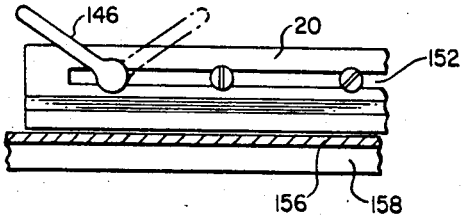
FIG. 21 is a view taken along the line 21—21 of FIG. 20 and shows the ruling edge fastening means.

The ruling edge 140 is similar to ruling 20 and is attached to the tangent bar 12 by suitable means. The ruling edge 140 is attached to the stacked elements by a pin assembly identical to that of FIG. 13 and having a screw 102, shank 104 and dowel 106. The end 144 of the ruling edge 20 is releasably secured by a pin 146 to end radial arm assembly 148, FIG. 20. The shank 150 of the pin slides in slot 152 in the ruling edge 20. By tightening or freezing the ruling edge 20 to the assembly 148, an arc constructed with the instrument can be frozen at a desired radius.

Figure 18:
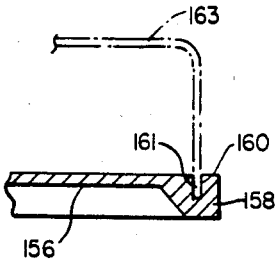
FIG. 18 is a view of a section of the base showing an edge thereof and a slot in the edge for receiving an edge of a transparent cover taken along the line 18—18 of FIG. 16.

The base 142 has a top flat surface 154, bottom surface 156, FIG. 18, and a block-like continuous bead or end 158 having a continuous slot 160 therein for the reception of a continuous edge 160 of a transparent top member 163 to be described below.

Figure 17:
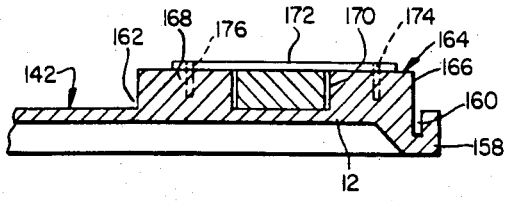
FIG. 17 is a view taken along the line 17—17 of FIG. 16 and shows a corner of the base having a raised portion on the base and a recess for receiving one end of the adjustable radial curve.

One corner 162, FIG. 17, of the base 142 has a raised portion 164 member having walls 166, 168 and a slot 170. The slot 170 snugly receives and supports the bar 12. A latch 172 is pivoted to wall 166 by a pin 174 and is held in place over the bar 12 by a latch pin mechanism 176. When the bar 12 is in position in the slot 170 and secured by the pin 172, the entire tool is securly held on the base 142.

Figure 19:
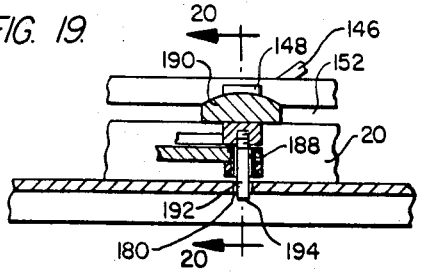
FIG. 19 is a cutaway view of the instrument taken along the line 19—19 of FIG. 16 and shows the base with slotted guideway and a guideway pin cooperating with the slotted guideway for routing the tool about the base.

The base 142 has a plurality of slotted parabolic setting guideways 180, 182, each having convex ruling edge indicia markings 184 and concave ruling edge indicia markings 186. The indicia may indicate measurements in either inches or centimeters. Cooperating with the slot 180 or 182 is a pin 188, FIGS. 16, 19 and 20, having a head 190 and a shank 192, the end 194 of which rides in said slots. The shank 192 extends through bores in the end radial arm and long chord assembly. A pin similar to pin 188 is utilized with the slotted guideway 182 when an arc of smaller dimension is desired. Other slots may be incorporated in the base to accommodate for either smaller or larger arcs.

Figure 22:
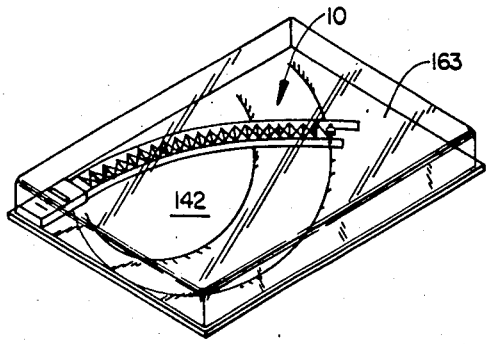
FIG. 22 is a plan view of the base, the instrument on the base and transparent cover.

FIG. 22 shows the instrument 10 secured to the base 142 and having a transparent cover 163, the bottom edge of which snaps in to slot 160. The instrument is thus readily viewed while on display on a store shelf. The base is constructed from suitable material to provide a smooth, flat, inflexible surface for the instrument to glide or rotate upon. The base should also be thick enough to provide a slot or recess to receive the guideway pin. It is contemplated that a suitable durable plastic material may be utilized. The base will be of a dimension to accommodate the longest arc to be used. To this end, a number of guideway slots may be incorporated on the base. In this embodiment, two slots are shown.

Figure 9:
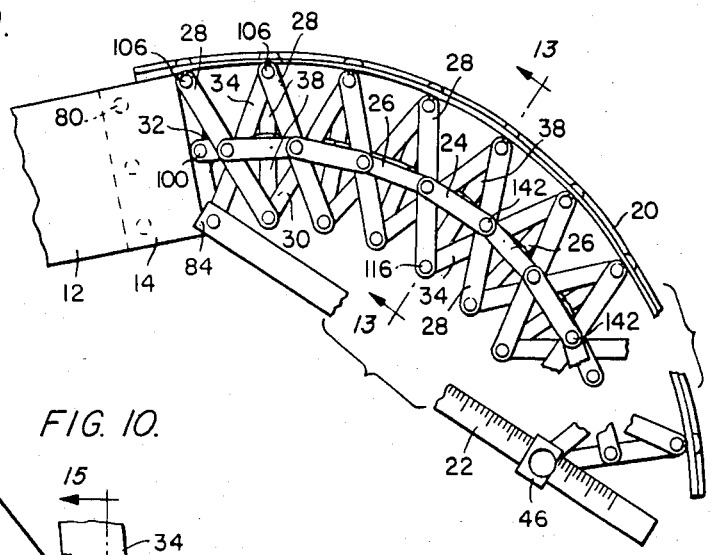
FIG. 9 is an enlarged plan view of the assembled invention showing the instrument in a partially curved position.
Figure 10:
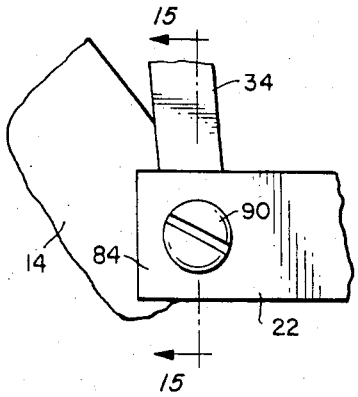
FIG. 10 is a plan view of the connection of one end of the bar scale to an end of a diagonal brace and the end tangent bar.

The parabolic guideway and scale together with cooperating guideway pin and the ruling edge locking pin provide a means for setting the instrument to a desired arc thus eliminating the bar scale 22 as seen in FIG. 9.

The parabolic guideway provides a geometric route for the adjustable radial curve radius setting scale instrument whereby the instrument may be set to form circles of given radius.

The principals of design of the parabolic guideway and the scale are determined from three knowns: (1) the overall length of the arc; (2) the length of the long chords; and (3) the total number of long chords used. Coordinate geometry, as well known in the art, is used in plotting the points of the guideway scale.

In operation, the bar 12 is secured in the slot 170 and the tool extended horizontally whereby the ruling edges are parallel. The pin 148 is inserted through the tool elements into the slotted guideway 180. A user may then rotate the adjustable radial curve along the slotted guideway 180 to a desired radius. The radius will then be read from the scale. The pin 146 is then tightened so that the ruling age 20 is firmly secured to the end radial arm assembly 148. The guideway pin 188 may then be removed and secured in an aperture 200 by a snap fit or other latching mechanism. The tool may then be removed from the base and circles of that given radius constructed.

To set a radius for use with the lower concave ruling edge, it is only necessary to add one to the radius desired and then set that radius on the parabolic scale. There is no need for a separate scale for the concave ruling edge.

The important features of the embodiment shown in FIG. 16 through 22 are: (1) the provision of a base and storage means for the instrument; (2) the provision of means to secure the bar 12 to the base; (3) the provision of guideways on the base cooperating with a pin through the instrument for constructing arcs of various radii; (4) means for locking the ruling edge to the end radial arm assembly whereby an arc of given radius is set; (5) a permanent storing location for the guideway pin when the tool is in use in constructing curves; and (6) a transparent cover for the base whereby the tool may be displayed and viewed on store shelves.

It is to be noted that the base may be used in reverse. That is, if it is desired to determine the radius of the curved surface, place the instrument on the curved surface then freeze the instrument by the locking pin, and then place the tool on the base whereby the radius may be read from the scale.

A modified form of the invention is shown in FIGS. 23 through 30. It will be understood that this modified form of the invention also incorporates the six layers of components as described above. In addition, there is a seventh component which will be explained in more detail below. In FIG. 23 there is shown the first level radial arm 201 having rounded ends 203. Adjacent the rounded end 203 are lower guide pins 205. Adjacent the lower guide pins 205 are dowels 207 between which there is a center dowel 209.

FIG. 24 shows the second and third level long chords 211 which are identical to the fifth and sixth level brace chords. The brace chords are designated 212 as noted in FIG. 24. These components are planar and have circular holes 115 near or adjacent to rounded ends 213.

FIG. 25 shows the second and third level diagonal braces 217 having rounded ends 220 which ends form a part of raised bosses 219 with rounded apertures 221 and innercircular ends 223.

FIG. 26 depicts the forth level diagonal brace 225 which is planar in nature and has rounded ends 227. Adjacent the rounded ends are circular apertures 229 between which there is a central dowel pin 230.

FIG. 27 shows the seventh level radial arm 231 having rounded ends 233. Adjacent the rounded ends 233 are guide pins 235 which cooperate with guide pins 205 of the first level radial arm to form an "H" section to receive an arm of a working edge to be explained below.

Figure 28:
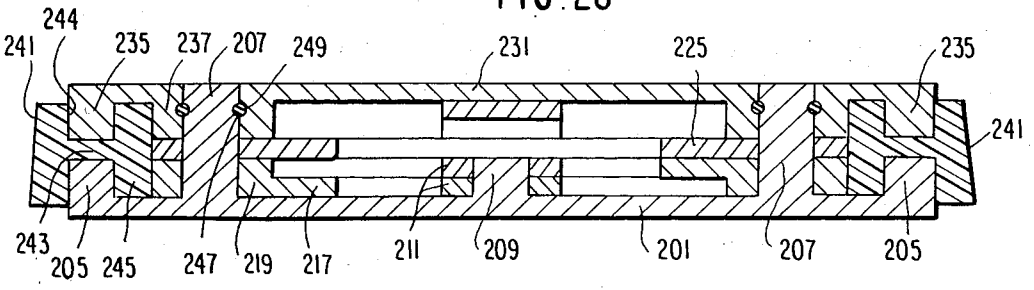
FIG. 28 is a view in section of the seven layers connected together and working edges.

Adjacent the guide pins 235 are raised rounded bosses 237 having rounded holes 239. The assembled components are shown in FIG. 28 and it will be noted that the working edges 241 have horizontal arms 243 which are positioned, between the guide pins 205 and 235 of the first and seventh components. The working edge 241 has a vertical arm 245 which is positioned, in the space 236 between the guide pins 205 and 235 and the bosses 237.

The innerface 244 of the working edge 241 abuts the outer curved surfaces of the guide pin 205 and 235 of the first and seventh components. The dowels 207 have raceways 247 to receive an O-ring 249 whereby all seven layers or components are held firmly together but are freely rotatable about the guide pins and dowels.

Figure 29:
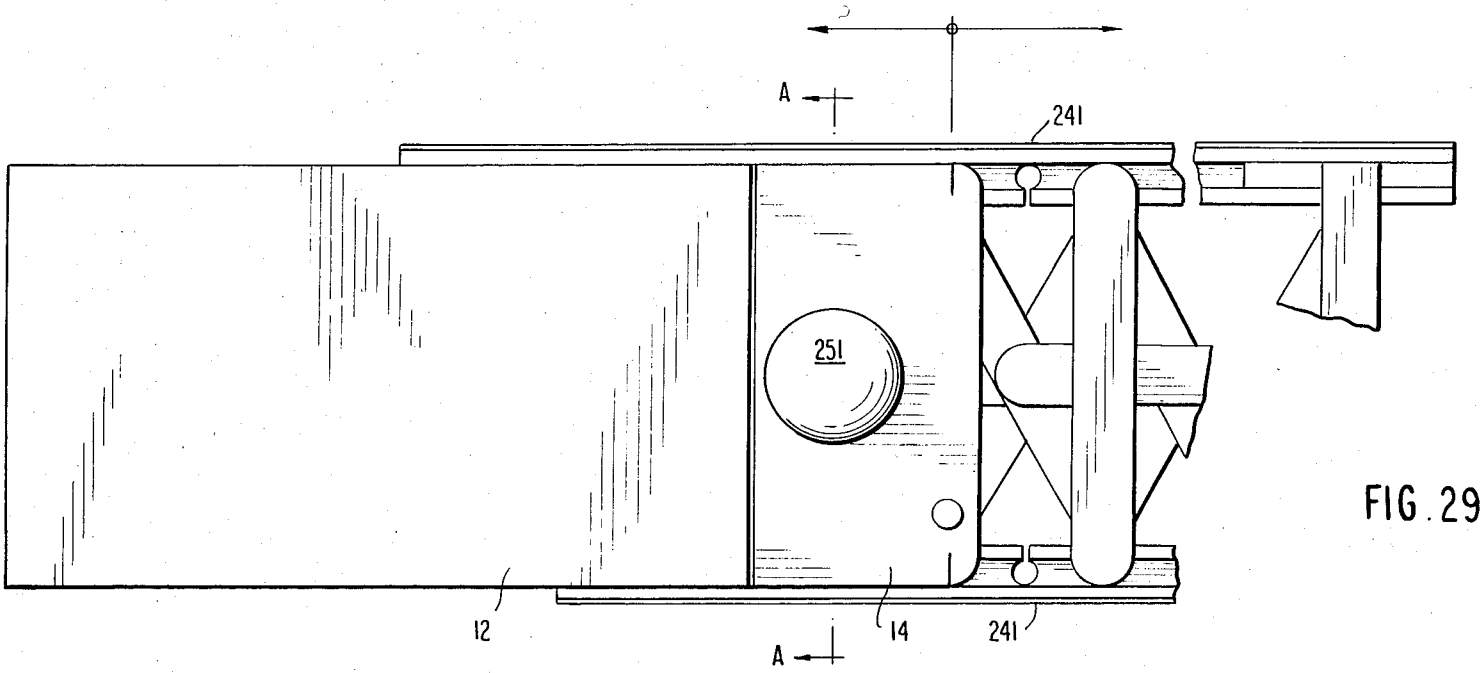
FIG. 29 is a plan view of an end of the radial curve showing several layers of components and also showing a latching knob.
Figure 30:
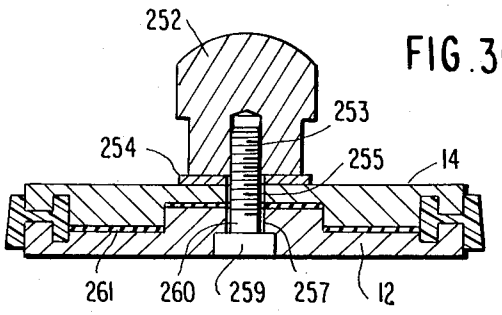
FIG. 30 is a view along the line A—A of FIG. 29 showing the latching mechanism in more detail.

FIG. 29 shows an end of the radial curve including the supporting tangent bar 12 and the tangent end radial arm 14. The working edges 241 are shown as are several layers of the components. The important feature is the knob 252 which functions to secure the working edges 241 in a pre-set radius. FIG. 30 shows the clamping or latching means in more detail. It will be seen that the knob 252 has a threaded aperture 253 therethrough. The knob 252 rests on a washer 254 which in turn rests on the radial arm 14. An aperture 255 extends through the component 14. There is a corresponding aperture 257 through the component 12. A screw having a large head 259 and shank 260 with threads thereon extend through the apertures in components 12 and 14, washer 254 and is received into the aperture in the knob 252. In order to secure the radial curve in a given radii, the knob 252 is turned so that the washer 254 and components 12 and 14 are tightened together between the compressible pad 261. The guide pins 205 and 235 are pressed against the arm 243 whereby the radial curve is set in a given radii and can only be changed by loosening the knob 252 to allow the components to move.

From viewing FIG. 28, it will be seen that the dowel pins 207 of the first level radial arm receives the rounded holes 221 of the diagonal braces 217. The rounded bosses 219 serves as spacers for the next level components. The central dowel 209 receives the apertures of component 211 as indicated. The dowel pins 207 of the first level radial arm also receives the end apertures 229 of the fourth level diagonal braces 225. Also, the central dowel 230 of the fourth level diagonal brace receives the end apertures of the fifth and sixth level brace chords 212 of FIG. 24. Then comes the seventh layer 231 wherein the apertures 239 of the bosses 207 receive the dowel pins 237. It will be appreciated that all of the components are locked together by means of the tight fit occasioned by the O-ring 249.

While the invention has been shown and described in detail with reference to a preferred embodiment thereof, it will be understood to those skilled in the art to which this invention pertains that various changes in form and detail may be made therein without departing from the spirit and scope of the invention.

What is claimed is:

1. An adjustable radial curve radius setting scale comprising:

a supporting bar;

a plurality of first level radial arms spaced apart and parallel;

second and third level long chords attached to the supporting bar and to the first radial arms;

a plurality of second level diagnoal braces attached to the supporting bar and to the radial arms;

a plurality of third level diagnoal braces attached to the supporting bar and to the radial arms;

a plurality of fourth level diagonal braces attached at their ends to the radial arms;

a plurality of fifth and sixth level brace chords attached to the fourth level diagonal braces;

a plurality of seventh level radial arms attached at their ends to the first radial arms; and at least one working edge secured between the first level and seventh level radial arms.

2. An adjustable radial curve radius setting scale according to claim 1, wherein:

said first level radial arms and said seventh radial arms have guide pins abutting a component of said working edge whereby said working edge may be clamped in a given radius.

3. An adjustable radial curve radius setting scale as described in claim 1, wherein:

said plurality of first level radial arms have outer dowel pins to receive the ends of the second, third and fourth level diagonal braces and a central dowel to receive the ends of the second and third level long chords.

4. An adjustable radial curve radius setting scale as defined in the claim 1, wherein:

said second and third level diagonal braces have raised bosses at their ends which function as spacers in the system.

5. An adjustable radial curve radius setting scale as defined in claim 1, wherein:

said fourth level diagonal braces have a central dowel to receive the ends of the fifth and sixth level brace chords.

6. An adjustable radial curve radius setting scale as defined in claim 1, wherein:

said seventh level radial arms have guide pins aligned with and opposite guide pins on the first level radial arms whereby said guide pins function to abut a component of the working edge to clamp said working edge between said guide pins.

7. An adjustable radial curve radius setting scale as defined in claim 6 wherein:

said seventh level radial arms have raised bosses adjacent the guide pins, said raised bosses have apertures to receive ends of dowel pins on the first radial arms.

8. An adjustable radial curve radius setting scale as defined in claim 7, wherein:

said dowel pins of said first radial arms have recesses to receive O-rings whereby the seveth level radial arms may be snapped-fitted to said dowel pins of said first radial arms.

9. An adjustable radial curve radius setting scale according to claim 7, wherein:

said radial arms, long chords, diagonal braces and braces chords being molded and said guide pins and dowel pins and raised bosses being integral therewith.

10. An adjustable radial curve radius setting scale according to claim 7, wherein:

said radial arms, long chords, diagonal braces and brace chords being die cast and said guide pins dowel pins and raised bosses being integral therewith.

11. An adjustable radial curve radius setting scale as defined in claim 1, and locking means for the first and seventh level radial arms to lock at least one working edge in a given pre-set radius.

12. An adjustable radial curve radius setting scale as defined in claim 1, wherein locking means for securing the position of the working edge and permitting movement of the working edge relative to said supporting bar when said locking means is released.

* * * * *